United States Patent [19]

Ip

[11] Patent Number: 4,874,327

[45] Date of Patent: Oct. 17, 1989

[54] UNIVERSAL CABLE HEAD FOR A MULTICONDUCTOR LOGGING CABLE

[75] Inventor: Matthew Ip, Austin, Tex.

[73] Assignee: Halliburton Logging Services, Inc., Houston, Tex.

[21] Appl. No.: 267,854

[22] Filed: Nov. 7, 1988

[51] Int. Cl.[4] ..... H01R 7/02

[52] U.S. Cl. ..... 439/275

[58] Field of Search ..... 439/271–282

[56] References Cited

U.S. PATENT DOCUMENTS

| | | | |
|---|---|---|---|
| 3,413,407 | 11/1968 | Potter | 439/275 |
| 3,594,701 | 7/1971 | Ramsey et al. | 439/275 |
| 3,871,734 | 3/1975 | Murtland | 439/275 |

*Primary Examiner*—Joseph H. McGlynn

*Attorney, Agent, or Firm*—William J. Beard

[57] ABSTRACT

A universal cable head is set forth which incorporates a stress relieving stinger on the end of a logging cable. The cable connects with wedge shaped members which grip the end of a cable within a housing. Electrical conductors, seven in number, extend from the end of the cable into the housing and are exposed in an internal cavity. In the cavity, they connect with a set of boots at the back end connecting with feedthrus by bayonet connection, the feedthrus being supported on a transverse bulkhead, and the feedthrus all extend through the bulkhead to locate male plugs within a circular housing. A rotatable threaded sleeve is on the exterior for connection with a mating female member. All of this structure connects universally to mating female connectors on downhole logging tools to provide the requisite number of conductors for downhole logging operations.

10 Claims, 1 Drawing Sheet

UNIVERSAL CABLE HEAD FOR A MULTICONDUCTOR LOGGING CABLE

BACKGROUND OF THE DISCLOSURE

A truck mounted wireline logging unit is typically used to raise or lower multitudinous downhole logging tools for wells drilled on land. For offshore locations, the wireline unit is typically mounted on a skid. The wireline unit normally includes a cable spooled on a drum, means for controllably measuring that cable as it is placed in a well borehole, and means for providing power and signal connections onto the cable. There are certain downhole tools which require only a single conductor. Many tools, however, require seven conductors along the armored logging cable. The wireline cable must operate any number of tools including small diameter tools, large diameter tools, those which run in open holes, those operative in cased holes, and those up to seven conductors. The present disclosure is directed to a cable head supporting a seven pin connector which routinely mates with different types of logging tools having similar reciprocating connectors affixed thereto.

Such a connector must overcome certain difficulties. To be universally usable, it is necessary to place seven conductors in the armored logging cable, and to that degree complexity is increased even when only one conductor of the seven is used. Service of the equipment is an important factor, especially so, service is important when switching over to one logging cable connection to another. In a typical armored cable, there are multiple layers of armor wires wrapped around the core and conductors; it is therefore difficult, sometimes impossible to seal around the bundle of wires without substantial time and effort. Moreover, in view of the fact that a wireline unit is typically used at a remote field location, field repairs are essential either for switching connections or to solve field maintenance problems. This prevents the use of elaborate sealing techniques, and prevents soldering because it is difficult to accomplish accurately in the field. Moreover, field repairs or field connection modifications are always accomplished under the pressure of time because delay is expensive in drilling rig rental costs.

Consider, as an example, switching from one kind of logging tool to another. In disconnection of the first logging system, one must first loosen and remove the thrust collar of the cable head to expose the rope socket and the various boots which surround the individual signal conductors. Each individual boot must be disconnected from the appropriate feedthrus which communicate through the pressure separation bulkhead. The various boots need to be reconnected to the mating equipment on the next logging tool downhole instrument. Moreover, the mechanical linkage between the wireline and the tool must be first interrupted and then reconnected on the new tool. These procedures are not promptly done, and can last up to two hours depending on practice and experience of the field personnel. It is even more difficult to accomplish in inclement weather. Moreover, it must be tested to assure that the electrical conductors, being (up to seven in number) are correctly connected through the equipment. It must be kept in mind that one conductor may be required to transmit a millivolt signal while another conductor may be required to transmit currents for operation of 100 amperes or more.

The present disclosure is directed to a uniform termination for a wireline which encloses a rope socket, seven boots and mating sockets for handling seven electrical conductors are appropriate feedthrus. The boots mate to the feedthrus in a enclosing connector housing. The feedthrus in the connector housing are arranged in a specified pattern so that a set of plugs protrudes on the other side of the feedthrus, defining multiple pins in a connector. The rope socket and the related boots are surrounded by a split sleeve. Stress relief is obtained in a stinger which spreads the cable load into the cable end fitting. The mating apparatus must conform in pin location and coacting members so that they are connected together and separated. This defines a structure which can be used to accomplish connection to a wide variety of downhole logging instruments.

The present disclosure thus illustrates and depicts a universal cable head adapted to be located on the end of a wireline constructed with the typical armor wraps around seven conductors including a core member. It will be described hereinafter as the universal cable head. The stinger is constructed with the typical strength member or load carrying member and has a stress relief stinger around the exterior. It terminates at the universal cable head which is adapted for connection to a mating tool mounted connector or a cable electrode. By placing mating cable heads on logging tools, a quick disconnect system is thus devised. More importantly, it is able to connect and disconnect without requiring any disassembly whatsoever of the components within the universal cable head. The multiple conductors terminate in feedthrus which easily connect where connection is accomplished so that axial loading on the cable head is handled in the intended fashion.

Briefly, the present apparatus incorporates a universal cable head having a stress relieving stinger fastened around the lower end of the armored logging cable. The armored logging cable terminates with a woven armored cable within multiple wraps of armor wire thereabout. Seven conductors are normally included and are terminated within a male connector housing with a transverse bulkhead. An appropriate set of feedthrus mounted on the bulkhead is included, the male plugs preferably being a central ground and seven feedthrus for conductors. They are held in a fixed pattern within the housing. Moreover, the housing completely surrounds them and provides a uniform mode of connection. There is a rotatable sleeve about the housing which can be rotated to accomplish threading. Threading is accomplished with the mating member to be described. In summary, a universal termination is developed for use in a downhole environment for connection to enable logging tools of any size in open or cased hole to be connected, and to provide up to seven conductors with a ground.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings:

FIG. 1 is a sectional view through a universal cable head on the lower end of an armored logging cable;

FIG. 2 is a mating female connector for the connector of FIG. 1 adapted to be integrated with a logging tool; and FIG. 3 is an alternate female cable electrode for connection with the cable head of FIG. 1.

DETAILED DESCRIPTION OF THE UNIVERSAL CABLE HEAD

Figure 1:
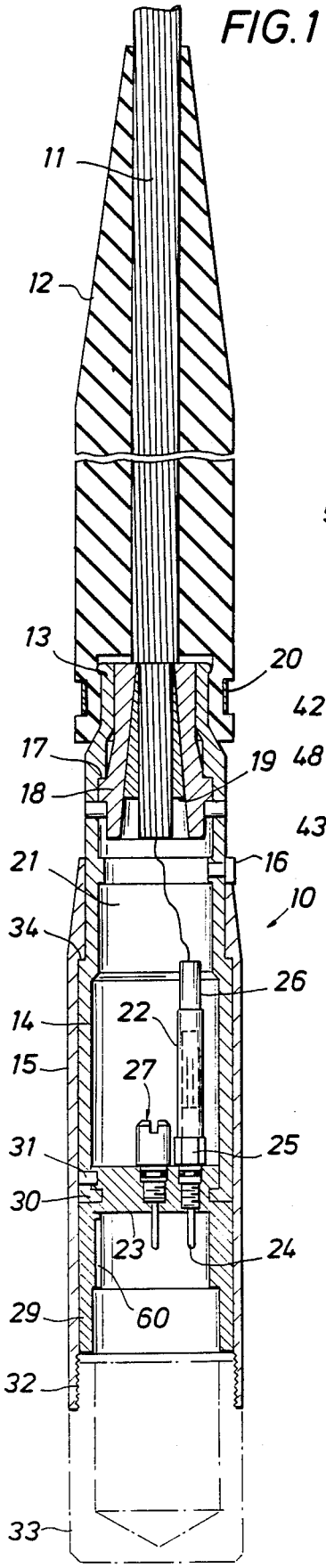

Attention is directed first to FIG. 1 of the drawings where the numeral 10 identifies a universal male cable head in accordance with the present disclosure. It is connected to an armored logging cable 11. This cable can be quite long, easily as long as 30,000 feet in length and is normally spooled on a large drum at the wellhead. It incorporates an armored wrap of one or two layers, a strength or core member made of a woven wire rope, and multiple conductors, and in this instance, seven conductors with an additional ground made through the strength member. The cable incorporates a tapered stress relief stinger 12. The cable connects with the male cable head 10 of the present disclosure and provides the requisite seven conductor connection which will enable connection to practically all logging tools.

The stinger 12 connects with a skirt 13 appended to a split elongate housing member 14. The housing member 14 is on the interior of a sleeve 15. The sleeve is able to rotate while the housing can not rotate. The sleeve is held in a locked position against rotation by a lock bolt 16 which fits in a notch at the end of the sleeve. The bolt 16 is removed and replaced to permit sleeve threading. The skirt 13 surrounds the end of the armored logging cable. It incorporates an internal shoulder 17 which abut a tapered thrust cone 18. The cone 18 fits snugly around the end of the cable, and a mating tapered wedge 19 is positioned between the cone and the tip of the cable. Wedging action is accomplished so that the end of the cable is gripped. Typically, the cable is trimmed back so that the external armor wrap is not caught, but rather the internal woven wire rope is captured in the wedge. The wedging action thus properly connects the cable terminus within the housing 14. The cone 18 is fastened in position by a pair of inwardly protruding pins from the split housing 14 which are received in matching slots to prevent rotation after locking. The components shown in FIG. 1 taper to the left to assure that tension locks the components within one another. The outer shoulder at the skirt 13 is surrounded by the terminus of the stress relieving stinger 12, and a garter ring 20 is positioned thereabout to clamp against slippage.

The cable includes seven individual conductors. There is a chamber or cavity 21 within the housing 14. The cavity provides room where the individual conductors can be separated from the end of the cable, and they extend upwardly to the feedthru assemblies shown at 22. Each feedthru assembly includes a boot which telescopes over the fixed feedthru which is a male or female electrical contact held in place by a nut. The feedthrus 22 are preferably duplicate to one another. They are all threaded to the bulkhead 23 which spans the housing. In fact, the housing is preferably made of multiple components so that the feedthrus 22 and bulkhead 23 can be removed as a unit. The individual feedthrus include three key components. The exposed connective part is the male plug 24 which is exposed for connection. Each one of the feedthrus 22 is held by means of threads on the body of the feedthru. The conductor connects with a resilient boot 26 which can pull off the feedthru. In summary, the several conductors are exposed within the chamber 21, hang out the end of the chamber and are then dressed by fixing them to the respective boots. The male plugs 24 are all mounted on the transverse bulkhead and threaded in place. The locking nut 25 is tightened to lock the feedthru in place. The numeral 27 identifies a central ground which is affixed in the center. The seven conductors are arranged in an evenly arranged about the central ground connector.

Assembly of the feedthrus is accomplished by fastening the male members to the bulkhead 23. The bulkhead 23 is a detachable structure as will be described. The bulkhead 23 thus supports the connectors 24 in an enclosure for protection. The disconnectable boots 26 from the conductors are fastened over the feedthrus, thereby completing electrical connection. The boots and the feedthrus are then protected by the split housing 14. The split housing 14 also serves as an alignment and strength linkage between the tapered members 18 and 19 and the bulkhead 23. Assembly of the cable head 10 should be detailed to assist in understanding the present apparatus.

The bulkhead 23 affixed to a surrounding skirt 29, the skirt comprising an extension for the housing 14. The skirt is joined to the housing by means of a protruding lip ring 30 of the split housing 14, Moreover, the split housing 14 is locked to the bulkhead 23 by means of one or two pins which are installed at 31. When this installation is complete, all of the protruding plugs 24 are enclosed within the skirt 29 and thereby define a set of male connectors.

As described to this juncture, easy access for the feedthru 22 has been described so that they can be repaired or serviced. The rubber boot 26 bayonets over the back end of the fixed portion held in place by the nut 25. This easy mode of assembly and disassembly permits quick repairs in the field.

Continue with the description of FIG. 1, the skirt 29 extends beyond the male plugs, and the sleeve 15 extends therebeyond. The sleeve terminates at an internal of threads 32. The threads 32 are shown in FIG. 1 threaded to a protective and disposable cap 33. The cap is normally used for storage, but it is removed when necessary. The cap threads to the threads 32 to provide storage protective for the cable head 10.

Figure 2:
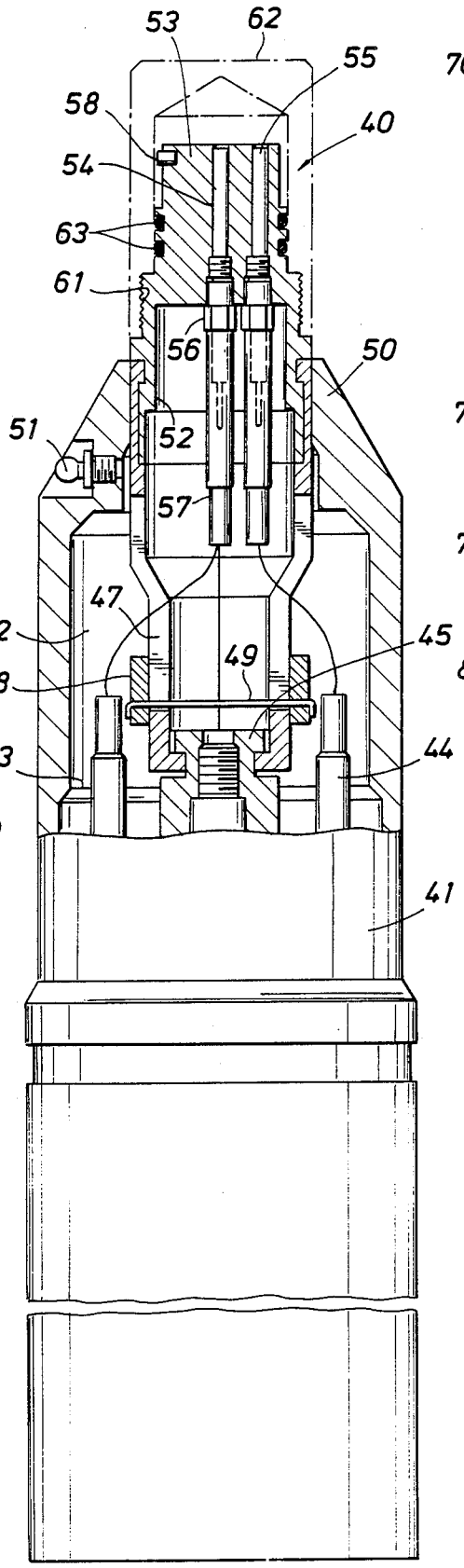

The sleeve 15 is rotatable, and bottoms out in position at a shoulder 34. That movement is restricted however by the lock bolt 16 after engagement to the tool string is made. When removed, the sleeve 15 is able to rotate. It is also rotatable so that it can be gripped with a wrench and rotated in making up a connection with a female member. Such a female member is shown in FIG. 2 of the drawings and is indicated generally by the numeral 40. The female connector 40 shown in FIG. 2 of the drawings is affixed to the top end of a housing 41 of a logging tool of any general description. The housing 41 is encloses an internal cavity 42. The housing also supports a bulkhead 43 incorporated for support of a set of feedthrus 44. The feedthrus 44 enable seven conductors (and a separate ground) to extend through the chamber 42 from the interior of the tool housing 41. The bulk head 43 supports an upstanding central post 45. A surrounding shoulder on the post 45 is joined to a split, flared sleeve 47 formed of identical circular halves. The split sleeve 47 is formed of two halves and is captured by a retaining sleeve 48 position there around. The connector thus is positioned therearound. The sleeve is positioned around the overhanging shoulder of the port 45, and two halves are pressed together by the ring 48 for locking. A wire staple 49 is also included to secure the ring 48 in location and to prevent ring slippage. The ring is perforated at appropriate locations to permit the wire staple 49 to extend through the ring. The two halves of the connector 47 are slotted so that the wire 49 and seven conductors can pass through the two halves.

The sleeve 47 flares outwardly and terminates on the interior of an open central passage in a tapered skirt 50. The hollow skirt receives an Amelite grease fitting 51 so that it can be packed with a waterproof non-conductive grease for protective purposes. Prior to packing, the sleeve 48 is locked with a lug and ring connection to a sleeve 52 which is centrally hollow along a portion of its length adjacent to a solid support body 53. The support body 53 holds a set of seven female feedthru generally indicated at 54. They mate with the male feedthrus shown in FIG. 1. Accordingly, the female sockets 55 are sized for the male members shown in FIG. 1. They are held fast in the solid body 53 by appropriate lock nuts 56. The feedthrus terminate at exposed terminals at the right hand side of FIG. 2 where the resilient boots 57 are slipped over the feedthrus to make the electrical connections necessary. Again, the feedthrus are positioned for mating so that seven are arranged in a circle, and a central ground connection is also included.

The solid body 53 has an external diameter sized to fit within the skirt 29 previously discussed, and has a guide pin 58 at a specified location. This guide pin is sized to slide into a matching groove 60 shown in FIG. 1. This is assures proper angular positioning of the various plugs and sockets. The body 53 is threaded at 61 for a disposable cap 62. The thread 61 match the threads 32 shown in FIG. 1. Thus, the sleeve 15 on the male connector 10 threads to the threads 61 to pull the body 53 into alignment so that the male and female feedthru properly connect. Since the sleeve 15 is able to rotate, the connectors 10 and 40 are thus forced together with assurance of proper alignment accomplished through the alignment pin 58 sliding into the groove 60.

Repair or service of the female connector 40 should occur far less than the male connector 10. Recall that the male cable head 10 is exposed to all types of environmental conditions including high pressures and high temperatures during logging. Moreover, since it is suspended on the end of a cable, it is likely to be banged and scuffed during movement along the well. Frequent field repairs and service is made easier by this system. It is not the same for the structure 40 because the female connector 40 is affixed to the top end of a logging tool while scuffing occurs elsewhere on the tool body. When the logging tool is stored at or the drilling site the cap 62 is placed over the female connector 40 which storage is until actual use. Connection of the female connector 40 with the male connector 10 is quite easily accomplished. The removable caps 33 and 62 are unthreaded and removed. The sleeve 15 in FIG. 1 is freed for rotation by removal of the screw 16. The sleeve threads to the female connector 40 while the respective male and female feedthru make connection. O-rings are installed in the grooves 63 to assure a fluid tight connection when male and female connectors are joined. By placing appropriate seal rings in the grooves at 63, the male connector on the cable head 10 is hermetically sealed to the female connector member 40 on the logging tool body. As will be understood, field service and repairs can be accomplished quite easily.

Figure 3:
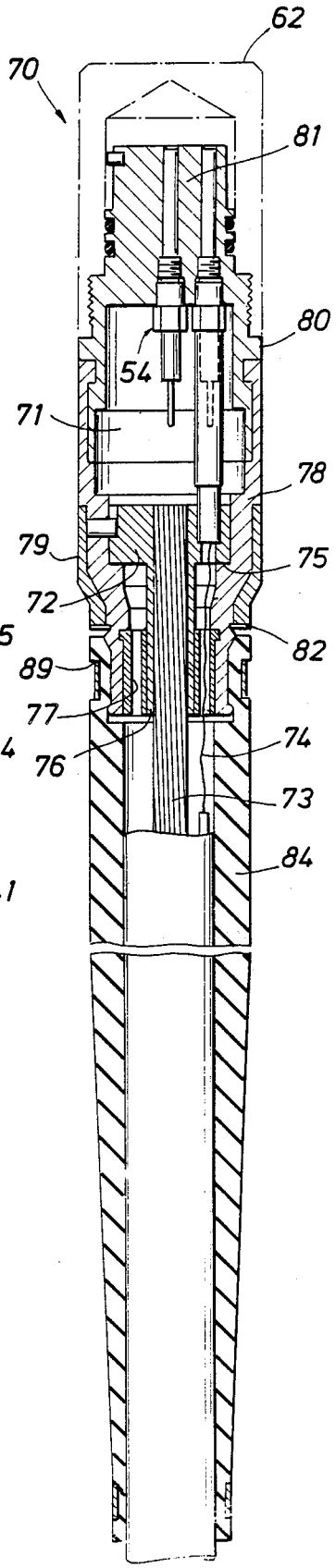

Attention is now directed to FIG. 3 of the drawings which shows a cable electrode terminating at an alternate embodiment 70 of a female connector. Again, it is covered over at the exposed end with a disposable and removable threaded cap 62. The female connector 70 incorporates duplicate female feedthrus to those shown generally at 54 in FIG. 2 of the drawings. They differ in that they terminate in a cavity 71 which is immediately within a housing 78. The housing encloses a cylindrical plug 72 which fits about the end of a cable portion 73. The cable is woven wire rope where the electrical conductors 74 are spaced around the periphery of the cable. The plug 72 is positioned against a shoulder 75. The plug 75 has a long neck 76 thereon, and the neck supports large sleeves 77 positioned to align the individual electrical conductors 74.

The split housing 78 is concentric within a hollow cylindrical member 79 which is positioned around to the shoulder 75 in the housing 78, and extends forwardly to lock to a forward housing member 80. The housing 80 connects to central plug 81 identical in construction to the plug 53 shown in FIG. 2. The exposed end of the female connector 70 is thus identical to the connector 40 shown in FIG. 2. The primary differences arise in the incorporation of the woven wire rope 73 which terminates in the plug 72.

The plug 72 is locked at the shoulder 75 within the funnel shaped member 78, and a snap ring 82 is incorporated to lock the member 79 in place. Stress relief sleeve 84 surrounds the wire rope 73 and shoulders on the housing 78. The sleeve 84 terminates in the surrounding flat at 85 to receive a snap ring for locking purposes.

Service on the apparatus shown in FIG. 3 is accomplished in the following manner. The stress relief sleeve 84 is moved along the cable to a position out of the way. The snap ring 82 is exposed at this time and is easily removed. This enables one to move the outer hollow housing 79 down the cable. The prior step exposes the split housing 78 to be opened so that both parts can be removed. In the step of opening the housing 78, the forward housing portion 80 (keyed thereto) can be moved to enable access to the conductors and boots. The feedthrus are formed with resilient boots identical to those shown in FIG. 2, the boots being adjacent to the plug 72. The cavity 71 thus provides plenty of working room for the boots so that they are positioned in alignment with the feedthrus which are connected by bayonet connection. In FIG. 3, the resilient boots (other than the central ground conductor) are held while in FIG. 2, the female connector 40 does not hold the boots. In FIG. 3, the boots are supported in the plug 72. The plug 72 serves another purpose, namely gripping the end of the wire rope 73 and thereby functions as a rope socket to transfer tension from the rope 73 into the surrounding shoulder 72 and the surrounding housing 78. As with the embodiment 40, the female feedthrus define sockets for the mating male plugs which are arranged in the common circle around the central ground plug and socket connection. The female connector is readily connected to a logging tool either directly or by extending the length of the sleeve 84 and the wire rope 73 on the interior. Sufficient space is left between the two concentric members for the conductors 74 to extend to the logging tool. Moreover, the conductors are in a secure location so that they are not exposed to the environment normally encountered in downhole well conditions.

While the foregoing is directed to the preferred embodiment, the scope thereof is determined by the claims which follow.

What is claimed is:

1. A universal cable head which comprises:

(a) an armored logging cable having up to seven electrical conductors therein and incorporating a woven wire rope, and a surrounding armor wrap;

(b) stress relieving stinger means on said cable;

(c) an encircling housing on the end of said cable having an external shoulder thereon connecting with said stress relieving stinger to transfer axial loads from said cable to said housing;

(d) an internal transverse bulkhead within said housing adjacent to an internal cavity therein;

(e) electrical feedthrus supported by said transverse bulkhead, said feedthrus having a cable end formed with terminals for connection of conductors in said logging cable;

(f) exposed mating connectors in a prearranged pattern supported by said bulkhead, said connectors being electrically connected to said feedthrus;

(g) said housing extending past and encircling said mating connectors; and (h) a rotatable, shoulder limited sleeve on the exterior of said housing having threading means thereon for connecting with a mating female connector.

2. The apparatus of claim 1 wherein said feedthrus incorporate locking nuts thereon anchoring said feedthrus on said bulkhead, and thereby position exposed terminals in said cavity and further including boots mounting on bayonet motion over said feedthrus.

3. The apparatus of claim 1 wherein said stinger terminates at an encircling collar about a portion of said housing and grips said housing to transfer stress from said logging cable into said housing.

4. The apparatus of claim 3 wherein said stinger and said housing are clamped together.

5. A female connector for mating with the male connector of claim 1 wherein the female connector incorporates a cylindrical solid body having a set of feedthrus mounted therein, wherein said feedthrus terminate at female sockets matching in number and placement the male connectors on the feedthru of said electrical connector, and further wherein said solid body supports said female feedthrus with exposed electrical terminals within a cavity within a surrounding housing to permit electrical conductors to be connected to said feedthrus.

6. The apparatus of claim 1 wherein stress relieving stinger means is secured to said housing by a clamp means.

7. The apparatus of claim 1 wherein said housing is divided into spaced chambers by said bulkhead, and said feedthrus form two ends, said ends located in said spaced chambers.

8. The apparatus of claim 7 wherein one of said chambers encloses a boot termination on a conductor of the logging cable, and the other of said chambers encloses said mating connectors.

9. The apparatus of claim 8 including a fixed portion of said feedthrus and detachable portion enclosed within said boot.

10. The apparatus of claim 1 wherein said sleeve is:

(a) releasably locked in position by a removable bolt means;

(c) concentric about said housing;

(c) limited in axial movement relative to said housing by a shoulder;

(d) longer than said housing; and (e) internally threaded to connect to a mating female connector.

* * * * *